US010077617B2

(12) United States Patent
Bell et al.

(10) Patent No.: US 10,077,617 B2
(45) Date of Patent: Sep. 18, 2018

(54) WELL TOOL CENTRALIZER SYSTEMS AND METHODS

(71) Applicants: William T. Bell, Huntsville, TX (US); James G. Rairigh, Houston, TX (US)

(72) Inventors: William T. Bell, Huntsville, TX (US); James G. Rairigh, Houston, TX (US)

( * ) Notice: Subject to any disclaimer, the term of this patent is extended or adjusted under 35 U.S.C. 154(b) by 445 days.

(21) Appl. No.: 14/825,005

(22) Filed: Aug. 12, 2015

(65) Prior Publication Data

US 2016/0273282 A1 Sep. 22, 2016

Related U.S. Application Data

(63) Continuation-in-part of application No. 14/644,544, filed on Mar. 20, 2015.

(51) Int. Cl.
*E21B 17/10* (2006.01)
*E21B 29/02* (2006.01)

(52) U.S. Cl.
CPC ..... *E21B 17/1078* (2013.01); *E21B 29/02* (2013.01)

(58) Field of Classification Search
CPC ..... E21B 17/1028; E21B 17/1078
See application file for complete search history.

(56) References Cited

U.S. PATENT DOCUMENTS 2,628,682 A * 2/1953 Wright ..... E21B 17/1028 166/173
2,717,650 A 9/1955 Hall
2,797,756 A 7/1957 Hall
2,845,128 A 7/1958 Clark, Jr. et al.
3,053,182 A 9/1962 Christopher
3,196,951 A 7/1965 Sauerenman
3,384,181 A * 5/1968 Maly ..... E21B 43/14 166/241.1
3,599,567 A 8/1971 Graham et al.
3,749,168 A 7/1973 Hall, Sr.
4,655,300 A * 4/1987 Davis, Jr. ..... E21B 12/02 175/39
4,898,104 A 2/1990 Savoy et al.
4,961,381 A 10/1990 McLaughlin
5,046,563 A 9/1991 Engel et al.
5,600,863 A 2/1997 Curran
5,924,489 A * 7/1999 Hatcher ..... E21B 29/02 166/298
6,695,537 B2 2/2004 Spraggon
7,073,448 B2 7/2006 Bell
(Continued)

*Primary Examiner* — Giovanna Collins Wright

(57) ABSTRACT

An apparatus and method, usable for centering downhole well tools within a pipe or wellbore, comprises a cylindrical end boss extension, from a distal end of a well tool housing, and a thin ring secured about said end boss comprising a plurality of radial apertures. Thin metallic wires, having distal ends secured within said apertures, extend radially from said ring into contact with the inside wall(s) of the pipe or wellbore. An alternative embodiment includes an annular extension from the distal end of said well tool that encloses a cavity within. A plurality of diametrically opposite apertures in said annular extension receives respective wires across a tool housing axis to project in opposite directions into contact with said inside wall of the pipe or wellbore. Said wires may be secured to said well tool by a potting compound, including a high temperature silica compound, an adhesive paste, or other compounds.

23 Claims, 4 Drawing Sheets

(56) References Cited

U.S. PATENT DOCUMENTS

| | | | | |
|---|---|---|---|---|
| 7,210,409 | B2 | 5/2007 | Johnson | |
| 2014/0345485 | A1 * | 11/2014 | Molina | H01H 3/16<br>102/202.14 |

* cited by examiner

WELL TOOL CENTRALIZER SYSTEMS AND METHODS

CROSS-REFERENCE TO RELATED APPLICATIONS

The present invention is a continuation-in-part application of U.S. patent application Ser. No. 14/664,544, entitled "Well Tool Centralizer Systems And Methods," filed Mar. 20, 2015, which is incorporated herein in its entirety.

FIELD OF THE INVENTION

The present invention relates to tools and methods for earth boring, well completion and production. More particularly, the invention relates to apparatus and methods for maintaining downhole tools approximately concentric with a pipe or tubing bore axis.

DESCRIPTION OF RELATED ART

In the process of well drilling, completion and production, there are numerous tools that require substantial centralization along the axis of a pipe or tube bore. In a frequently arising example, it becomes necessary to cut a pipe or tube at a point deep within a borehole. Such remote pipe cutting is often performed with a shaped charge of explosive.

Briefly, shaped charge explosives for pipe cutting generally comprise a disc of highly compressed explosive material, such as RDX or HMX, having a V-groove channel formed about the disc perimeter. A thin cladding of metal is intimately formed against the V-groove surface. When ignited at the center of the disc, the opposite flanks of the V-groove expansively explode against each other to produce a rapidly expanding radial disc of extremely high temperature, molten metal. The impact of this molten metal disc upon a surrounding pipe or tubing wall is to sever the pipe wall by hydrodynamically splashing pipe material in the impact plane.

Although reliable and effective when expertly applied, the radial cutting capacity of shaped charge cutters is usually limited to only a few inches from the perimeter of the explosive material disc. Moreover, this radial cutting capacity may be further limited by downhole fluid pressure. When detonated under a downhole fluid pressure of 18,000 psi, the cutting capacity of a shaped charge cutter may be reduced by as much as 40%. If the cutter alignment within the pipe is eccentric with the pipe axis, an incomplete cut may result.

Other examples of required axial position control for downhole tools include well measurement and logging processes, where the radial proximity of the pipe wall is influential upon the measured data.

As a functional method, well tool centralizers are known in the prior art. U.S. Pat. No. 7,073,448 to W. T. Bell describes a shaped charge cutter housing having a centralizer comprising four blades positioned in a single plane and attached by a single fastener at the distal end of the housing. U.S. Pat. No. 5,046,563 to W. T. Engel et al. describes three flat springs formed into bows with one end of each attached to the end of a shaped charge cutter housing. U.S. Pat. No. 4,961,381 to P. D. McLaughlin describes a borehole centering device for blasthole primers comprising a plurality of thin, radially extending spikes secured to a central ring. The spikes are made of a semi-conducting plastic, and the central ring is sized to fit over a primer case. A further example of centralizers is disclosed by S. T. Graham et al., in U.S. Pat. No. 3,599,567, including plastic wing members radiating from a drive point for attachment over the end of a stick of explosive. The wing members have the purpose of holding the buoyant explosive down as well as centralizing the charge within a shothole. The explosive casing cutter disclosure of U.S. Pat. No. 3,053,182, to G. B. Christopher, describes a plurality of backswept spring wires secured to the cutter housing in borings directed angularly to the tool axis. Clamping screws engage portions of the spring wires extending into the bore of the housing.

In adapting prior art centralizing devices to downhole tools, such as pipe and tubing cutters, difficulties arise in the form of excess material usage for forming multiple centering blades from a single sheet of spring steel. In addition, centralizers, with elaborate designs, present fabrication/assembly difficulties.

One object of the present invention, therefore, is to provide the art with an inexpensively fabricated and easily attachable well tool centralizer.

SUMMARY OF THE INVENTION

One embodiment of the present invention comprises two or more thin, resilient metal discs attached to a tool housing end. Each disc can be secured by a single pin fastener through the disc center. The fastener is placed near the perimeter of the tool housing, whereby only an arcuate portion of a disc projects, substantially normally to the longitudinal tool axis and beyond the tool perimeter, to engage a pipe or tubing inside wall surface.

As another invention embodiment, ends of thin, spring steel wires can be inserted into corresponding apertures, in a base ring having a different diameter, and the wires can be secured by an interference fit. Such an interference fit may be obtained by swaging or by thermal shrinkage. Alternatively, another attachment method may be used, such as soldering or gluing the spring steel wires directly to the base of the tool housing. The spring steel wires can then engage the inside of the wellbore, during insertion or withdrawal of the tool, for centralizing the tool.

In another embodiment of the present invention, a plurality of thin, spring steel blades or wires can be attached, via a plurality of fasteners, to the end of the tool housing. After attachment, the plurality of fasteners can act to prevent rotation of the centralizers (e.g., spring steel blades or wires) during insertion or withdrawal of the tool, and the length of the blades or wires can be cut or customized to ensure contact with (and thus centralization relative to) the inner walls of the wellbore for centralizing the downhole tool.

In another embodiment of the present invention, an apparatus for centralizing a downhole tool includes a substantially cylindrical housing configured for suspension within the walls of a pipe or a wellbore. The housing comprises an annular projection extending from its distal end, and a plurality of radial apertures are formed in the annular projection and distributed about a circumference of the annular projection. At least one wire can be secured within at least one respective aperture of the plurality of radial apertures to extend radially from the annular projection, and the at least one wire can contact an inner wall of the pipe or wellbore to centralize the downhole tool. The annular projection can include a cylindrical boss extended axially from the distal end of the cylindrical housing. In an embodiment, the annular projection can include a ring secured about the cylindrical boss extending axially from the distal end of the housing. The at least one wire can be secured within said respective radial apertures by a swaged expansion of each of the at least one wires against an inner wall of the at least one respective radial apertures, or secured within the at least one radial aperture by such methods as soldering, welding, use of an adhesive or compound, and/or an interference fit.

In an embodiment, the annular projection can comprise a material annulus secured to the substantially cylindrical housing, and materially integral with the housing, which circumscribes a cavity. The plurality of radial apertures can be inserted through the material annulus and arranged in pairs. The at least one wire can be threaded through at least one of the pairs of radial apertures, such that each of the at least one wires projects radially beyond the material annulus. A potting compound (e.g., sodium silicate, a paste comprising sodium silicate, a paste comprising sodium silicate and kaolin, an adhesive paste, a high temperature adhesive) can be placed in the cavity, and around at least a portion of the at least one wire within the cavity, to secure the at least one wire for centralizing the downhole tool.

In another embodiment of the present invention, methods are usable for securing a centralizer to a downhole well tool. The steps of the methods include extending a material annulus from the distal end of the downhole well tool to circumscribe a cavity, and providing a plurality of apertures disposed radially and arranged in pairs in the material annulus. The steps of the methods can further include inserting at least one wire through each pair of the plurality of apertures to project the at least one wire radially from opposite sides of the material annulus, and securing the at least one wire within the cavity with a potting compound.

BRIEF DESCRIPTION OF THE DRAWINGS

The invention is hereafter described in detail and with reference to the drawings wherein like reference characters designate like or similar elements throughout the several figures and views that collectively comprise the drawings. Respective to each drawing figure.

DETAILED DESCRIPTION OF EMBODIMENTS OF THE INVENTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
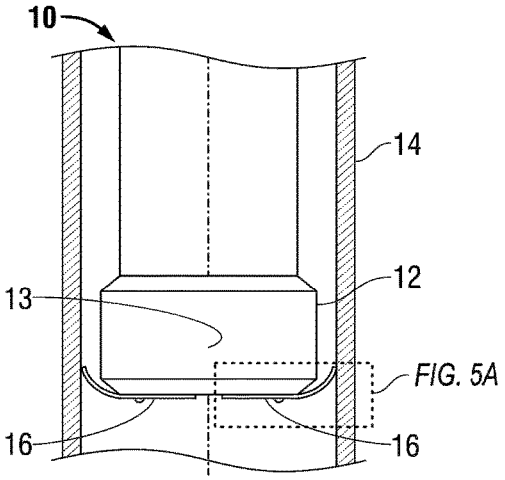
FIG. 1 is a longitudinal section of pipe enclosing a shaped charge pipe cutting tool fitted with one embodiment of the present invention.
Figure 2:
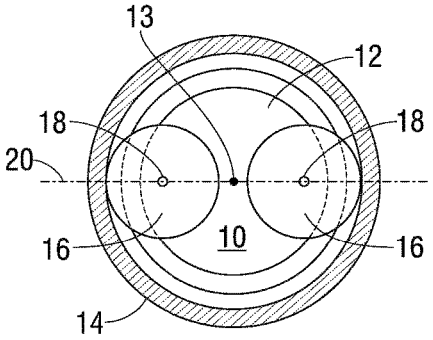
FIG. 2 is a cross section of the FIG. 1 illustration showing a plan view of an embodiment of the invention.

With respect to FIGS. 1 and 2, an embodiment of the invention is shown which includes a tubing cutter 10 having explosives (not shown) within a housing 12. The tubing cutter 10 is shown as located within a downhole tube 14. The tubing cutter 10 is centrally confined within the downhole tube 14 by a pair of centralizing discs 16 having a substantially circular planform.

As shown in FIG. 2, the centralizing discs 16 can be secured to the cutter housing 12 by anchor pin fasteners 18, shown in this embodiment as screws. The disc plane is substantially normally oriented to the housing axis 13, as shown in FIGS. 1 and 2. Since the discs 16 are not expected to rotate about the anchor pins 18, swage rivets or other fasteners may serve for securing the discs to the housing 12.

In the embodiments shown in FIGS. 1 and 2, the discs are mounted along a diameter line 20 across the cutter housing 12, with the most distant points on the disc perimeters separated by a dimension that is at least the amount corresponding to the inside diameter of the tubing 14. In many cases, however, it will be desirable to have a disc perimeter separation that is slightly greater than the internal diameter of the tubing 14. This configuration is illustrated by the upward sweep in the discs in contact with the inside wall of the tubing 14.

Attention is particularly directed to the geometric consequence of two, relatively small diameter discs 16 secured on the diametric centerline of a larger diameter circle, with opposite extreme locus points of the disc 16 perimeter coinciding with diagonally opposite locus points on the larger circle perimeter. Any force on the tool housing 12, substantially normal to the diameter 20, can be opposed by a wedging reaction against the inside wall curvature of the tube 14. This wedging reaction can be applied to the disc 16 perimeters and, ultimately, to the housing 12 by the mounting pins 18 to maintain the axial center of the housing 12 in directions transverse to the diameter 20.

Figure 4:
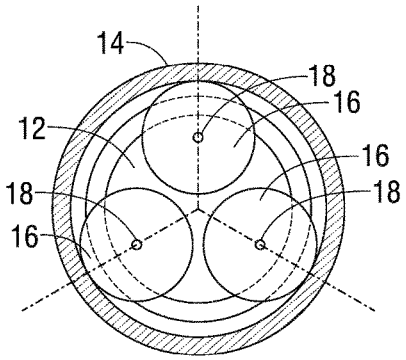
FIG. 4 is a plan view of an alternative configuration of the invention.

In another embodiment of the invention, as shown in FIG. 4, three discs 16 can be secured by pin fasteners 18 to the housing at approximately 120° arcuate spacing about the housing axis 13 (shown in FIG. 2). In this embodiment, the most distant elements of the disc 16 perimeters from the housing axis 13 at least coincide with the inside perimeter locus of the tubing 14.

The embodiment shown in FIG. 4 is representative of applications for a multiplicity of centering discs on a tool housing 12. Depending on the relative sizes of the tool 10 and pipe 14, there may be three or more such discs distributed at substantially uniform arcs about the tool circumference.

Regarding the disc 16 properties, the terms "thin", "resilient" and "metallic" are used herein to generally describe gage thickness of high carbon and heat treated "spring" steels. Although other metal alloys are functionally suitable, the parameter of economics is a strong driver of the invention, and exotic alloys are relatively expensive.

Figure 5A:
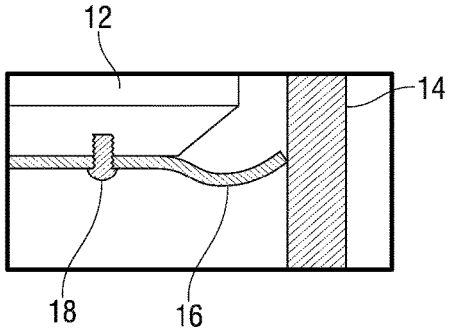
FIG. 5A is an operative detail of an embodiment of the invention in a tool withdrawal mode.

Within this triad of material properties for a specific disc 16 application, the gage thickness and bending modulus are paramount for the reason best illustrated by FIG. 5A. This Fig. shows a centralizing disc 16 that can be secured to the cutter housing 12 by at least one anchor pin fastener 18, which is shown in this embodiment as a screw. In the event that a well tool 10 must be withdrawn from a downhole location, the projecting arc of the disc 16 can be compressively deformed to reverse the drag sweep against the tubing wall. If the tool 10 is suspended in the tube 14 by the use of a wireline or slick line, not shown, a potential exists for exceeding the tensile strength of the support line. A well tool supported by a tubing or pipe string is not as limited. Nevertheless, the disc 16 design limitations of "thin" and "resilient" have particular meaning for specific applications of the invention.

Figure 5B:
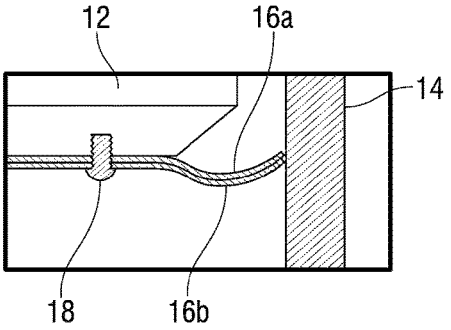
FIG. 5B is an operative detail of an alternative embodiment of the invention in withdrawal mode.

Furthermore, as illustrated in FIG. 5B, such designs have advantages in that they can be provided in a "stack" configuration, illustrated here as a pair of discs, 16*a* and 16*b*, each having a thickness less than the disc 16 illustrated in FIG. 5A. Such configurations can provide centralizing force, which is nearly equivalent to a single disc thickness, while reducing the force required to insert or withdraw the tool 10 from the tube 14 due to the reduction in compressive stress along the diameter of the discs 16*a*, 16*b*.

Figure 3:
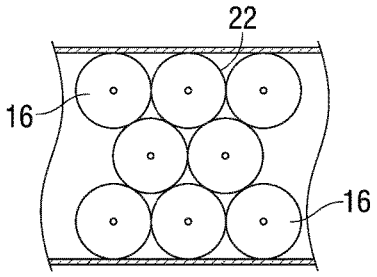
FIG. 3 is a sheet metal die cutting pattern for centralizing discs, illustrating the material utilization efficiency of this invention.

While the centralizing force created by the arcuate projection of discs 16 beyond the tool housing 12 perimeter is an operative element of the invention, the economics of fabrication is an equally driving feature. Configurations other than a full circle may also provide an arcuate projection from the tool housing 12 perimeter. However, many alternate configurations are either more expensive to form or waste more fabrication material. Shown by FIG. 3 is a disc 16 stamping pattern as imposed against a stock sheet of thin, resilient metal material 22. When compared to single plane cross or star pattern centralizers, the percentage of material waste for a disc pattern is minimal.

Figure 6:
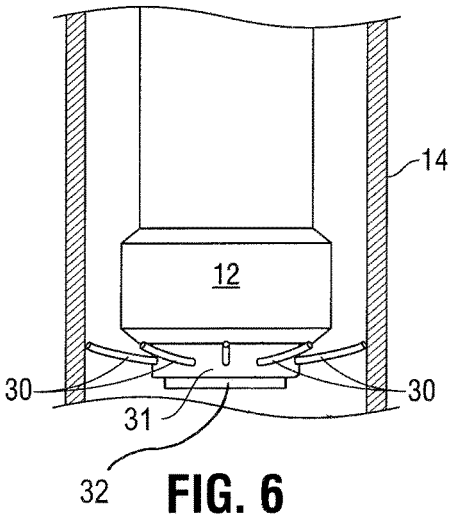
FIG. 6 is a partially sectioned elevation showing an alternative embodiment of the invention.
Figure 8A:
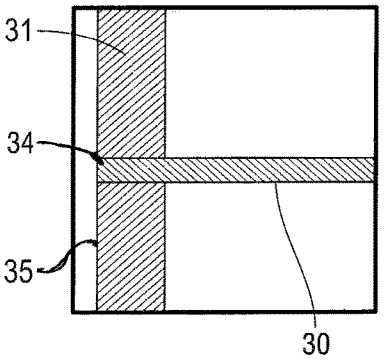
FIG. 8A is an enlarged cross-section of one method of fitting the centering wires to the anchoring ring apertures of the FIG. 6 embodiment.
Figure 8B:
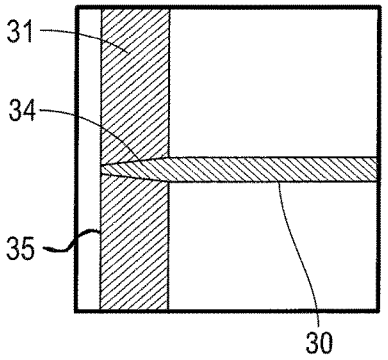
FIG. 8B is an enlarged cross-section detail of another method of fitting the centering wires to the anchoring ring apertures of the FIG. 6 embodiment.

Referring now to FIG. 6, another economically driven embodiment of the invention is illustrated which includes spring steel centralizing wires 30 of small gage diameter. A plurality of these centralizing wires 30 are secured in apertures 34, as shown in FIGS. 8A and 8B, to extend radially from an anchor ring 31. The anchor ring can be secured to an end boss 32 extension from the tool housing 12. The end boss 32 can be machined as an integrated part of the tool housing 12 to be of a slightly smaller diameter than the major diameter of the housing. Note that the scale and angle of the end boss 32 is depicted in FIG. 6 for clarity; however in alternative embodiments, the end boss 32 can be any configuration of the distal end of the tool housing 12. A slip fit assembly of the anchor ring 31 to the end boss 32 may be secured, for example, by set screws, welding, solder or adhesive. The centralizing wires 30 can be formed of high-carbon steel, stainless steel, or any metallic or metallic composite material with sufficient flexibility and tensile strength.

It will also be understood by those of skill in the art that the apertures 34 may be formed into a straight, flat material band that is subsequently rolled into a ring. For example, the apertures may be drilled into a flat band; and then, the centralizing wires 30 can be set in the apertures of the flat band, which can be subsequently rolled into a ring 31 in which the opposite ends of the band are welded together. Furthermore, the wires 30 that are attached to the flat band can be rolled about or around the end boss 32 and, then, welded into place. In an alternative embodiment, the centralizing wires 30 can be inserted into apertures formed in the end boss 32 and secured into place by methods that include interference fit, gluing or soldering, or the centralizing wires 30 can be attached directly to the end boss 32 and secured into place by methods that include gluing, butt welding, interference fitting, or soldering of the wires 30.

Figure 7:
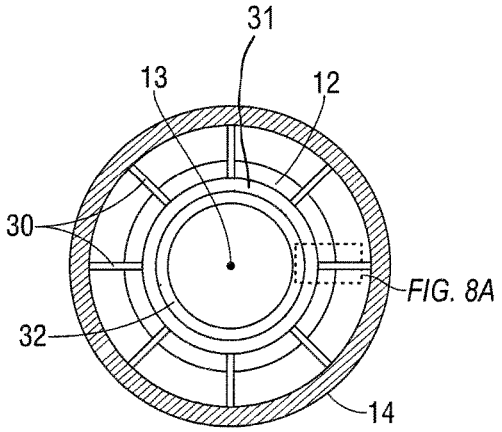
FIG. 7 is a plan view of the FIG. 6 invention embodiment.

Referring next to FIG. 7, a plan view of the configuration in FIG. 6 is shown, with the plurality of centralizing wires 30 projecting outwardly in a radial arrangement from the anchor ring 31 positioned around an end boss 32. While the depicted configuration includes a total of eight centralizing wires 30, it should be appreciated that the plurality may be made up of any number of centralizing wires 30, or in some cases, as few as three. As can be seen in the plan view, the use of centralizing wires 30, rather than blades or other machined pieces, allows for the advantageous maximization of space in the flowbore around the centralizing system, compared to previous spider-type centralizers, by minimizing the cross-section compared to systems featuring flat blades or other planar configurations.

As with the configuration of FIGS. 1 through 4, the wires 30 of FIGS. 6 and 7 are normally oriented to the housing axis 13 and operatively engaged with the sides of the tubing 14. Wires 30 are sized, such that the wire 30 length can be slightly greater than the distance from the inside face of the anchoring ring 31 and the inside bore wall of the tubing 14. Thus, the wires 30 will exert compressive force to centralize the tubing cutter 10, and flex in the same fashion as the cross-section of discs 16, shown in FIG. 1 and FIG. 5A, during insertion and withdrawal. The length of the wires 30 may be sized for a specific inside diameter of a tubing 14, either before or after attachment to the end boss 32.

Referring now to FIG. 8A, one embodiment of the centralizer system represented by FIGS. 6 and 7 is shown in partial cross-section, including the anchor ring 31 having the plurality of radial apertures 34 penetrating the anchor ring 31 thickness. The apertures 34 can be sized to accommodate the diameter of the wires 30, which can be secured within the apertures 34 via adhesive, soldering, or other methods.

The FIG. 8A embodiment may also represent a shrink-fit or interference fit assembly by which the apertures 34 are formed of slightly less inside diameter than the outside diameter of the wires 30. For assembly, the apertures 34 may be enlarged by heating or the wires 30 shrunk by cooling.

Referring next to FIG. 8B, an alternative attachment method is shown for the FIG. 6 through 7 embodiment, in which the diameter of the aperture 34 is slightly tapered toward the inside anchor ring 31 face 35 (as shown in FIG. 8A) to an inside diameter smaller than the body of the wires 30. A press fit of the wire 30 into the tapered aperture enables an interference fit between the wires 30 and the aperture 34, where the proximal ends of the wires 30 can be subjected to compressive force(s) and can be deformed slightly to fit the narrower aperture 34.

Figure 8C:
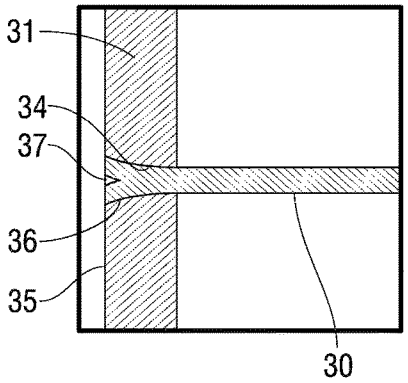
FIG. 8C is an enlarged cross-section detail of a swage method of fitting the centering wires to the anchoring ring of the FIG. 6 embodiment.

Another method for attaching the centralizing wires 30 to the anchor ring 31 is the swage process, which is shown in FIG. 8C. By the swage method of FIG. 8C, the apertures 34 are formed to a close sliding fit for the centralizing wire 30. Additionally, the aperture 34 is belled on the inside face 35 of the anchor ring 31. Upon insertion into the aperture, the end of the centralizing wire 30 can be dimpled 37 in the center, to expand the outside diameter 36 of the wire 30, tightly, against the walls of the aperture 34.

Figure 9:
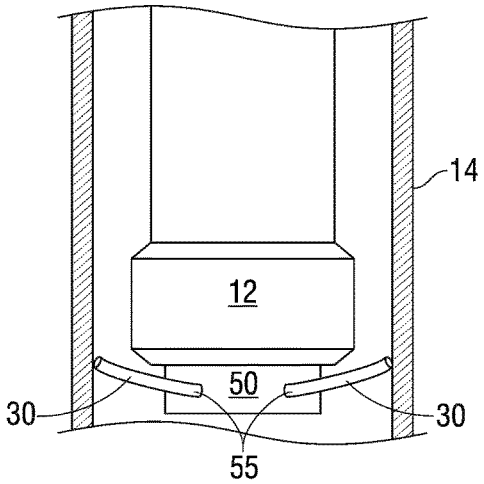
FIG. 9 is a longitudinal section of pipe enclosing a shaped charge cutting tool having an integral annulus anchor for centralizing wires.
Figure 10:
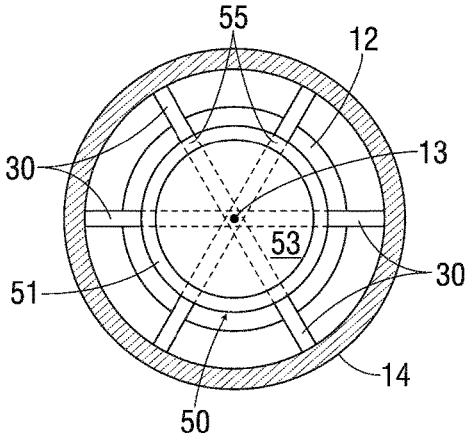
FIG. 10 is a cross-section plan of the FIG. 9 embodiment of the present invention.

A further method of attaching centralizing wires 30 to a cutter housing 12 is represented by FIGS. 9 and 10. In this embodiment, the centralizing wire 30 anchor ring 50 is a materially integral extension of the cutter housing 12. The annulus 51 of the anchor ring encircles a cavity 53. Diametrically aligned apertures 55, through the wall of the annulus 51, can receive the wires 30 that can be of a continuous length, and the wires 30 can traverse the cavity 53 to cross at the housing axis 13. After the placing and aligning of the wires 30, the cavity 53 can be filled around the crossing of the wires 30 with a suitable potting compound, such as Versachem™ sealant, which is produced by ITW Permatex of Hartford, Conn. Versachem™ is a proprietary paste compound comprising kaolin and sodium silicate and having high temperature adhesive properties.

Figure 11:
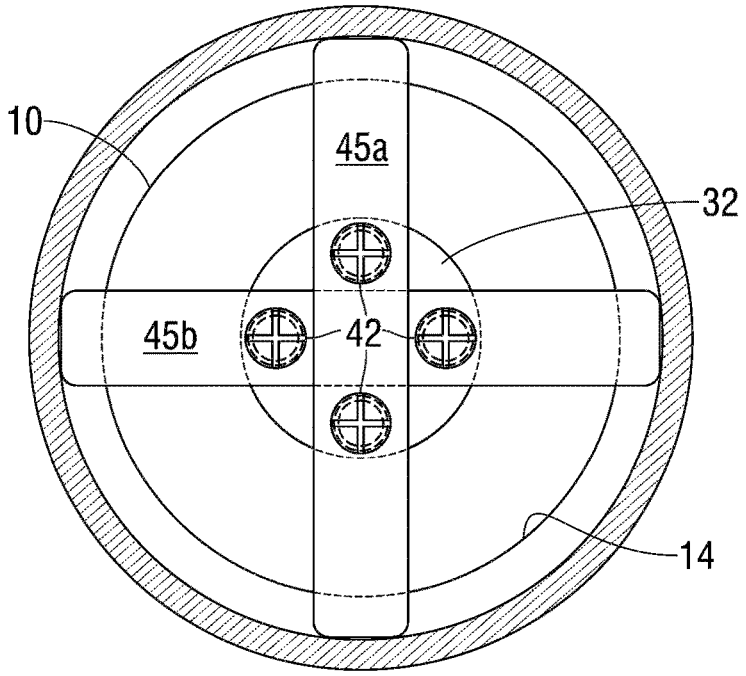
FIG. 11 depicts an alternative embodiment of the present invention comprising a plurality of planar, finger-like structures usable for centralizing a tubing cutter.
Figure 12:
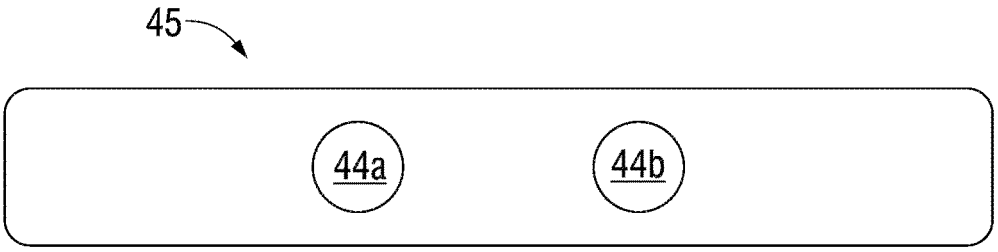
FIG. 12 depicts an embodiment of a single blade, from the plurality of blades, for use in centralizing a tubing cutter.

Referring now to FIGS. 11 and 12, a third embodiment of the invention is illustrated herein. This configuration comprises a plurality of planar, finger-like structures (herein "blades") that can be used to centralize a tubing cutter 10. The plurality of blades 45*a*, 45*b* can be secured to the bottom surface of the tubing cutter boss 32 by a plurality of threaded fasteners 42, which are inserted through each blade. The plurality of blades 45*a*, 45*b* can project outwardly from the cutter boss 32 to flex against the sides of the wellbore 14 and to exert a centralizing force in substantially the same fashion as the embodiments of the disc 16 depicted in FIGS. 1, 5A and 5B. Thus, it can be appreciated that the plurality of blades 45*a*, 45*b* can comprise a stacked embodiment, in which the thickness of each blade 45 is reduced to stack multiple blades 45 on the same plurality of fasteners 42.

FIG. 12 depicts an embodiment of a single blade 45, and the blade 45 comprises a plurality of attachment points 44*a*, 44*b*, through which fasteners 42 can secure the blade 45 into position. While the embodiment in FIG. 11 is depicted with two blades 45*a*, 45*b*, each with two attachment points (attachment points 44*a*, 44*b* for one blade 45 are shown in FIG. 12), for a total of four fasteners 42, it should be appreciated that the invention may comprise any number of blades, fasteners and attachment points.

Significantly, the multiple attachment points 44 on each blade 45, being spaced laterally from each other, prevent the unintentional rotation of individual blades 45, even in the event that fasteners 42 are slightly loose from attachment points 44. In addition, each blade 45 can be manufactured at low cost from a pre-selected width of coil material and simply cut for length, obviating the need in the prior art for specially designed and cut centralizer patterns.

Although the invention disclosed herein has been described in terms of specified and presently preferred embodiments, which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. An apparatus for centralizing a downhole tool, wherein the apparatus comprises:

a substantially cylindrical housing configured for suspension within a pipe or a wellbore, wherein said substantially cylindrical housing comprises an annular projection from a distal end of said substantially cylindrical housing circumscribing a cavity;

a plurality of radial apertures inserted through said annular projection, wherein said plurality of radial apertures are distributed about a circumference of said annular projection in pairs; and at least one wire threaded through at least one of said pairs of the plurality of radial apertures, wherein each of the at least one wire extends radially from and beyond said annular projection, wherein said at least one wire contacts an inner wall of said pipe or said wellbore to centralize the downhole tool.

2. The apparatus of claim 1, wherein said annular projection comprises a cylindrical boss extended axially from the distal end of said substantially cylindrical housing.

3. The apparatus of claim 1, wherein said annular projection comprises a ring secured about a cylindrical boss extending axially from the distal end of said substantially cylindrical housing.

4. The apparatus of claim 1, wherein said at least one wire is secured within said at least one of said respective pairs of the plurality of radial apertures by a swaged expansion of each of said at least one wire against an inner wall of said at least one of said respective pairs of the plurality of radial apertures.

5. The apparatus of claim 1, wherein said at least one wire is secured within said at least one of said respective pairs of the plurality of radial apertures by soldering.

6. The apparatus of claim 1, wherein said at least one wire is secured within said at least one of said respective pairs of the plurality of radial apertures by welding.

7. The apparatus of claim 1, wherein said at least one wire is secured within said at least one of said respective pairs of the plurality of radial apertures by adhesive.

8. The apparatus of claim 1, wherein said at least one wires are resilient and are secured within said at least one of said respective pairs of the plurality of radial apertures by an interference fit.

9. The apparatus of claim 1, further comprising a potting compound placed in said cavity, wherein said potting compound is placed around at least a portion of said at least one wire within said cavity.

10. The apparatus of claim 9, wherein said annular projection comprises a material annulus that is materially integral with said substantially cylindrical housing.

11. The apparatus of claim 9, wherein said potting compound is a paste comprising sodium silicate.

12. The apparatus of claim 9, wherein said potting compound is an adhesive paste.

13. An apparatus having a substantially cylindrical housing configured for suspension within a downhole pipe or a wellbore, said apparatus comprising:

said substantially cylindrical housing having a materially integral extension from a distal end of said substantially cylindrical housing, wherein said materially integral extension is in the form of a material annulus around an internal cavity;

said material annulus having a plurality of apertures traversing said material annulus, wherein said plurality of apertures is arranged in pairs of respective apertures;

at least one wire threaded through at least one of said pairs of respective apertures and across said internal cavity to project radially beyond said material annulus; and a potting compound placed in said cavity and surrounding portions of said at least one wire within said internal cavity.

14. The apparatus of claim 13, wherein said potting compound is an adhesive paste.

15. The apparatus of claim 13, wherein said potting compound is a high temperature adhesive.

16. The apparatus of claim 13, wherein said potting compound is a paste comprising sodium silicate.

17. The apparatus of claim 13, wherein said potting compound is a paste comprising kaolin and sodium silicate.

18. A method of securing a centralizer to a downhole well tool, wherein said method comprises the steps of:

extending a material annulus from the distal end of said downhole well tool to circumscribe a cavity;

providing a plurality of apertures disposed radially and arranged in pairs in said material annulus;

inserting at least one wire through each pair of said plurality of apertures to project said at least one wire radially from opposite sides of said material annulus; and securing said at least one wire within said cavity with a potting compound.

19. The method of claim 18, wherein said potting compound is an adhesive paste.

20. The method of claim 18, wherein said potting compound is a high temperature adhesive.

21. The method of claim 18, wherein said potting compound comprises sodium silicate.

22. The method of claim 18, wherein said potting compound comprises kaolin.

23. The method of claim 18, wherein said potting compound comprises sodium silicate and kaolin.

* * * * *